US006935505B1

(12) United States Patent
Nash, Jr. et al.

(10) Patent No.: US 6,935,505 B1
(45) Date of Patent: Aug. 30, 2005

(54) COLLAPSIBLE TORTILLA SUPPORT APPARATUS

(76) Inventors: Jonathan Nash, Jr., 1814 Sand Point Dr., Carter Lake, IA (US) 51510; Aaron R. Easley, 1414 S. 3rd St., Suite 112, Minneapolis, MN (US) 55454

( * ) Notice: Subject to any disclaimer, the term of this patent is extended or adjusted under 35 U.S.C. 154(b) by 33 days.

(21) Appl. No.: 10/438,735

(22) Filed: May 15, 2003

(51) Int. Cl.[7] ..... B65D 5/00
(52) U.S. Cl. ..... 206/562; 206/564; 206/485; 206/486; 206/590; 229/938; 426/110
(58) Field of Search ..... 206/443, 446, 206/485, 486, 590, 546, 562, 564; 211/70.1, 211/85.4, 72, 73; D7/504; 229/938; 426/106, 426/124, 126, 110

(56) References Cited

U.S. PATENT DOCUMENTS 1,638,480 A * 8/1927 Feybusch ..... 426/132
3,390,783 A * 7/1968 Quackenbush, Jr. ..... 211/73
3,682,597 A * 8/1972 Husch ..... 422/58
3,987,892 A * 10/1976 Killy ..... 206/563
4,434,890 A * 3/1984 Sieck et al. ..... 206/443
4,746,010 A * 5/1988 Fournier ..... 206/746
5,203,493 A * 4/1993 Moody ..... 229/103
5,725,109 A * 3/1998 Moulton et al. ..... 211/73
6,019,224 A * 2/2000 Rich ..... 206/546

* cited by examiner

*Primary Examiner*—David T. Fidei
(74) *Attorney, Agent, or Firm*—Merchant & Gould

(57) ABSTRACT

The present invention comprises a tortilla housing and support apparatus, configured to be manipulated so that the housing performs as a tortilla support device that provides vertical support to at least one tortilla. The tortilla housing and support apparatus is initially used as a tortilla-packaging box, such as tortilla boxes currently in use at supermarkets for housing tortillas. The tortilla housing has a configuration so that it may be manipulated from serving as packaging so that it performs as a tortilla support device.

9 Claims, 9 Drawing Sheets

COLLAPSIBLE TORTILLA SUPPORT APPARATUS

TECHNICAL FIELD

This application generally relates to food packaging configured to be manipulated so that the packaging performs as a dinning support apparatus for transporting and supporting in an upright position tacos, tortillas, fajita wraps, gorditas, chalupas and the like.

BACKGROUND

Mexican food, particularly those dishes that utilize tacos and tortillas, has become very popular in the United States. The Mexican foods market, including the fast food, dine-in/sit down restaurant and the home production and consumption segments, has grown into a multi-billion dollar industry. Many individuals enjoy the fast food and restaurant version of Mexican taco and tortilla-based dishes, while many others prefer to construct their taco and tortilla-based dishes at home using fresh ingredients. However, the nature of many popular taco and tortilla dishes present several undesirable problems for taco and tortilla preparers and consumers.

One such problem encountered in preparation of tacos and tortillas is that, since taco shells have a rounded base and tortillas revert to a flat disc shape when not held in hand, it is very difficult to support taco shells and tortillas in an upright or manageably stable position while filling the taco and tortilla, respectively, with the desired ingredients, such as meat, beans, vegetables, and/or salsa, etc. Unfortunately, the taco and tortilla builder's effort often results in a mess wherein many of the taco ingredients end up outside the taco shell or in unmanageable proportions on tortillas during the construction process. There is therefore a need for a taco shell and tortilla support device, which will support tacos and tortillas in a position to reduce waste and mess and simplify the taco and tortilla filling process.

Moreover, following preparation of tacos and tortillas, tacos are presented on their side on a plate. This can lead to much of the taco filling falling out of the taco shell onto the plate. When tortillas are presented on a plate, they lay open and are presented as a mound of ingredients that tend to distribute all over the tortilla, thus causing the loss of tortilla fillings when the consumer picks up the tortilla filled with ingredients. Tacos and tortillas are currently transported and supported by plates, papers or an apparatus such as that disclosed in U.S. Pat. No. 6,019,224. When paper or plates are used as transport or support devices, they yield the undesirable need for action by the food consumer to replace or redistribute the taco and tortilla fillings in the tortilla shell. Further, the presentation of tacos and tortillas on paper or plates is not the most aesthetically pleasing method and could subtract from the entire eating experience.

Another problem that is occurring in the Mexican foods market, including the fast food, dine-in/sit down restaurant and the home production and consumption segments, is that there is substantial waste occurring as a result of the inefficient use of packaging and support materials. In the fast food, dine-in/sit down restaurant segment, tacos and tortillas are packaged and provided to the customer wrapped in paper. The paper is then discarded and the tacos and/or tortillas are supported and presented on a plate. In the home production and consumption segment, taco and tortilla kits are sold in boxes filled with taco and/or tortilla shells and fillings, including meat seasoning. In this environment the box used as packaging is discarded. The tacos and tortillas are then prepared and presented on their side on paper or a standard dinner plate. There is a need for taco and tortilla packaging that can serve as initial packaging and as the transport and support apparatus in the fast food, dine-in/sit down restaurant and the home production and consumption segments. The packaging needed would prevent waste associated with having separate packaging and support apparatuses.

Accordingly, there is a need for an improved tortilla packaging and support apparatus. The present invention provides a solution to many problems, such as those discussed above, currently faced in the industry.

SUMMARY

The present invention provides a tortilla support apparatus comprised of a collapsible, generally rectangular box having a base wall, a top wall, and an intermediate wall disposed between the base wall and the top wall. The apparatus further includes a sidewall assembly that is integrally coupled to the base wall and top wall, respectively. The collapsible tortilla support apparatus top wall includes tortilla-receiving apertures and the intermediate wall positioned below and substantially parallel to the top wall also includes tortilla-receiving openings. The tortilla receiving apertures of the top wall and intermediate wall are aligned so as to create tortilla-receiving chambers within the collapsible tortilla support apparatus. The base wall of the collapsible tortilla support apparatus also serves as the base wall of the tortilla-receiving chambers. The tortilla receiving apertures within the intermediate wall provide additional support and stabilization to tortillas positioned within the tortilla receiving chambers. The collapsible tortilla support apparatus is configured such that the side wall assembly, which is hingedly connected to the base wall and top wall provides for the expansion of the collapsible support apparatus to an upright tortilla support position and the collapsing of the tortilla support apparatus to a generally flat storage position.

These and various other features as well as advantages which characterize the present invention will be apparent from a reading of the following detailed description and a review of the associated drawings.

DETAILED DESCRIPTION

The present invention is an improved tortilla support apparatus that is configured such that it may be manipulated from a flat storage position to a support position where it performs as a tortilla support apparatus that provides vertical support to tortillas. As used herein, the definition of the term "tortilla" refers to and comprises hard u-shaped shells, soft taco shells, fajitas wraps, gorditas, chalupas and any other edible soft or hard shell food support device resembling hard and soft shell tacos, fajitas, gorditas, chalupas and wraps. In the embodiments of the invention disclosed herein, the tortilla support apparatus is configured such it may be collapsed from a generally rectangular configuration to it becomes flat. In its rectangular configuration, the tortilla support apparatus provides support to tortillas in an upright position, allowing the tortilla ingredients to be added and supported without spilling. The support apparatus includes a base wall, top wall and intermediate support wall. The base wall is the bottom of the support apparatus and supports the tortillas when positioned in the apparatus. The top wall is positioned above and generally perpendicular to the base wall. The top wall has tortilla-receiving openings formed therein, which receive tortillas position on the apparatus. The intermediate wall of the apparatus is positioned between and generally parallel to the base wall and the top wall and has tortilla-receiving openings formed therein. The intermediate wall tortilla-receiving apertures are directly below the tortilla-receiving openings formed in the top wall and provide enhanced support and stabilization for tortillas. The intermediate wall and top wall tortilla-receiving openings act in concert to create a tortilla-receiving chambers. The use of the intermediate wall and top wall and their respective tortilla-receiving apertures creates tortilla receiving chambers that provide additional middle range support on the body of a tortilla when positioned in such devices.

Figure 1:
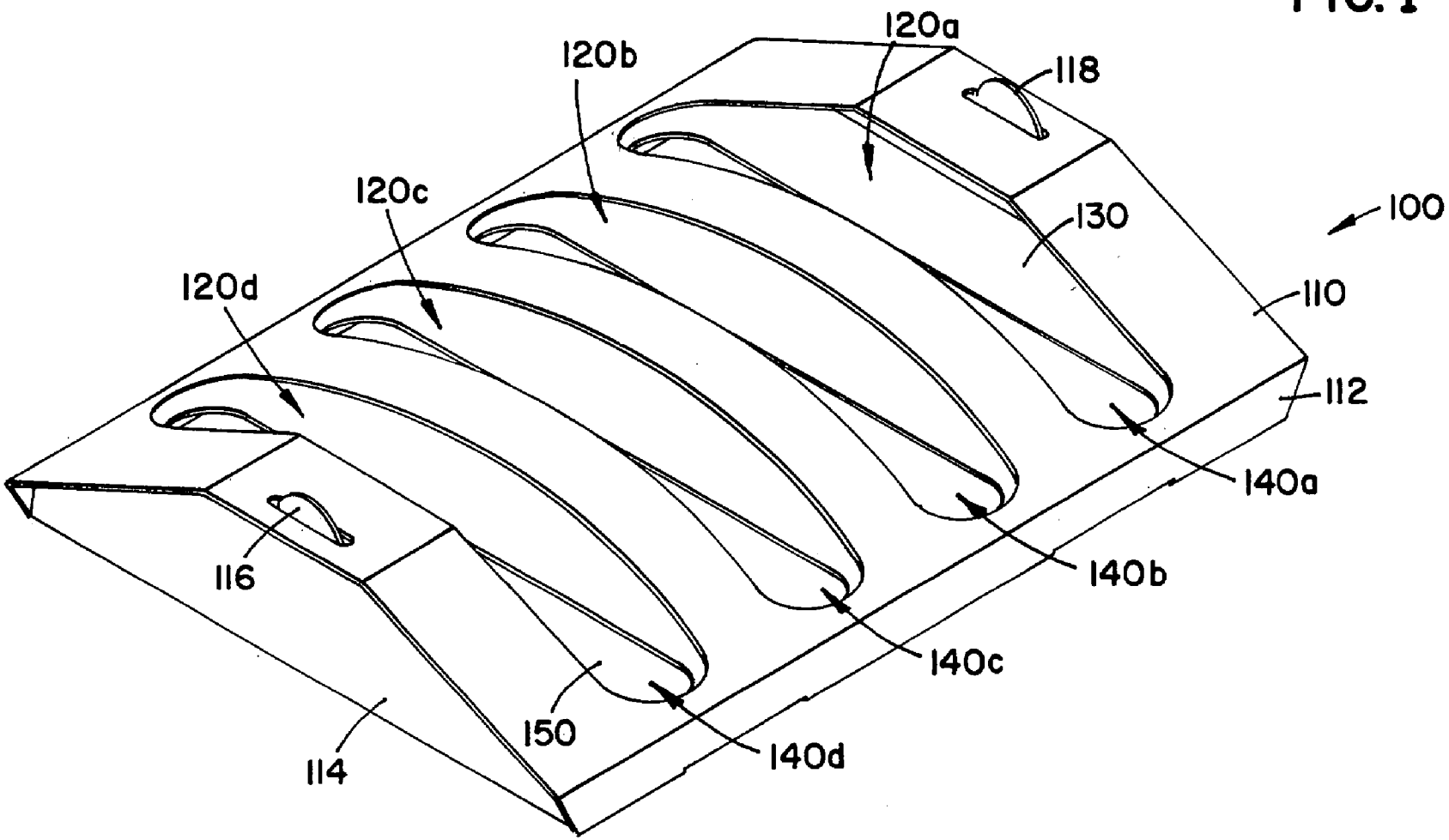
FIG. 1 is a prospective view of a tortilla support apparatus of the present invention.
Figure 2:
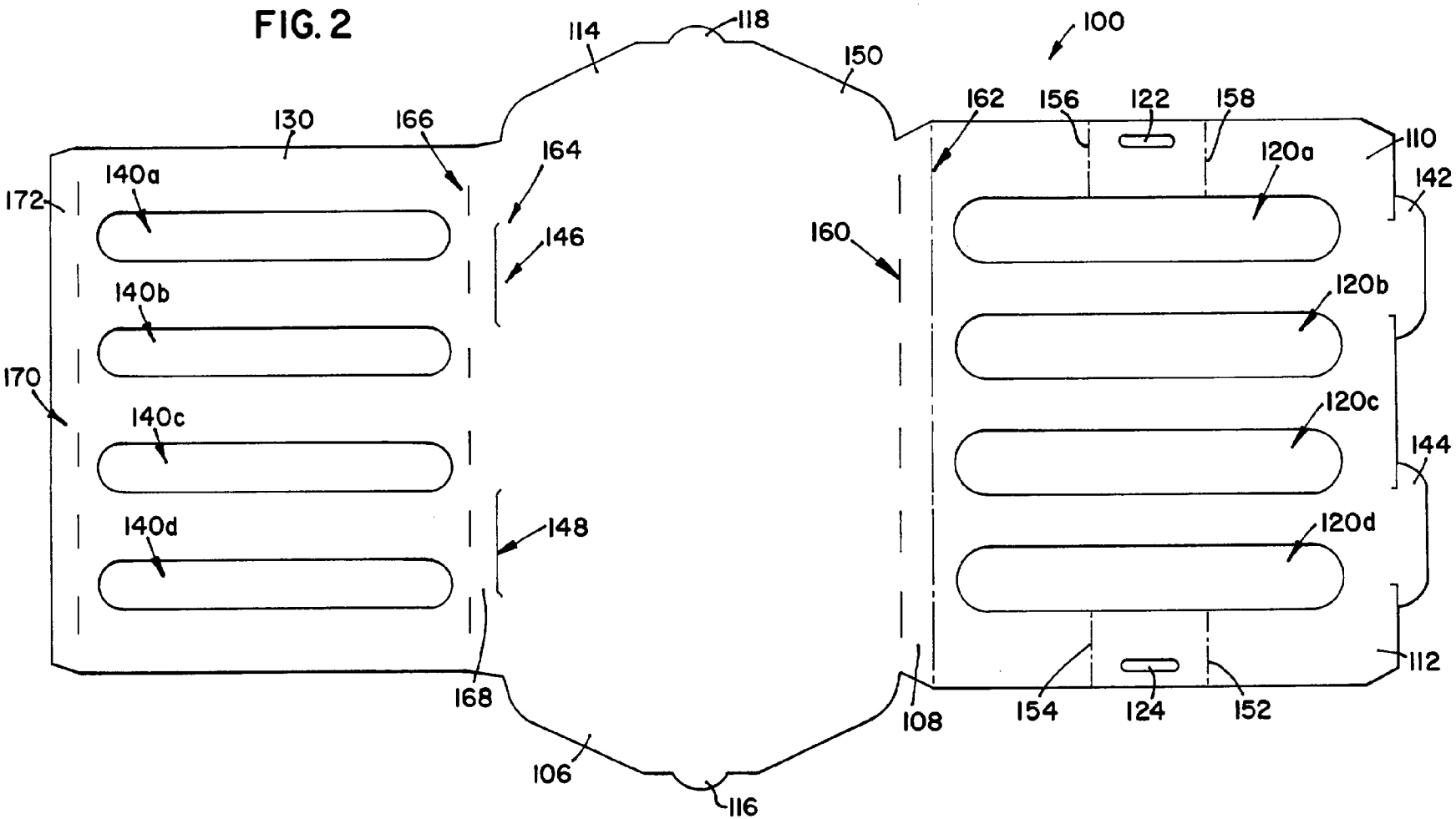
FIG. 2 is a prospective view of the tortilla support apparatus disclosed in FIG. 1 collapsed into its flat storage position.

Embodiments of the tortilla support apparatus of the present invention are shown in FIGS. 1 through 9. As illustrated in FIGS. 1 and 2, a first embodiment of the collapsible tortilla support apparatus 100 includes first and second sidewalls 106 and 114, third and fourth side walls 108 and 112, a base wall 150, and a curved top wall 110. The first and second sidewalls 106 and 114 and the third and fourth sidewalls 108 and 112 are hingedly connected to the base wall 150. In the preferred embodiment, the hinged connection between the base wall 150 and the first side wall 106, the second side wall 114, the third side wall 108 and the fourth side wall 112 is accomplished by a fold or crease formed in the construction material of the tortilla support apparatus 100. A first hinged crease 160 is positioned between the base wall 150 and the third sidewall 108. A second hinged crease 162 is positioned between the third sidewall 108 and the top wall 110. Hinged crease 160 provides the hinge assembly necessary to permit the top wall 110 and the side wall 108 to be pivoted from the flat storage position illustrated in FIG. 2 to an upright position, as illustrated in FIG. 1. Upon the pivoting of first side wall 106 and second side wall 114 to a position at which the first and second side walls 106 and 114 are perpendicular to the base wall 150, the intermediate wall 130 is folded up and over the base wall 150 so that the intermediate wall 130 and the base wall 150 are generally parallel. Intermediate wall 130 is folded along a third hinged crease 164 between the base wall 150 and the first intermediate wall support sidewall 168 and along a fourth hinged crease 166 between the intermediate wall 130 and the first intermediate wall support sidewall 168. Upon folding of intermediate wall 130, the first intermediate wall support sidewall 168 becomes generally perpendicular to the base wall 150 and the intermediate wall 130. Second intermediate wall support sidewall 172 is also folded along hinged second intermediate hinged crease 170 so that the second intermediate wall support sidewall 172 is generally perpendicular to the intermediate wall 130. Intermediate wall is above base wall 150 in a generally parallel position at a distance the equivalent of the height of first and second intermediate wall support sidewalls 168 and 172. In manipulating the collapsible tortilla support apparatus 100 to its upright position, the first and second sidewall tabs 116 and 118 are slid through a first sidewall tab receiving slot 124 and a second side wall tab receiving slot 122. In addition, first and second sidewall tabs 142 and 144 are slid through first and second top wall tab receiving slots 146 and 148.

As illustrated in FIG. 1, collapsible tortilla support apparatus top wall 110 includes a plurality of tortilla receiving apertures 120*a*, 120*b*, 120*c*, and 120*d*, each which have a length of approximately 5–7 inches and a width of approximately one inch, although the dimensions may be modified as desired by the manufacturing of the present invention. The tortilla receiving apertures 120*a*, 120*b*, 120*c*, and 120*d*, are designed to receive a tortilla. The intermediate wall 130 also includes a plurality of tortilla receiving apertures 140*a*, 140*b*, 140*c* and 140*d*, each of which has a length of approximately one half inch shorter than the length of the tortilla receiving apertures of top wall 110, and a width of approximately one fourth of an inch shorter than the width of the tortilla receiving apertures of the top wall 110. It is to be understood that these dimensions may be modified as desired by the manufacture of the present invention. The tortilla receiving apertures 140*a*, 140*b*, 140*c* and 140*d* are designed to receive a tortilla and the aperture edges engage the external surface of the tortilla and provide medium range stabilization support to the center of the tortilla as the edges of the top wall tortilla receiving apertures 120*a*, 120*b*, 120*c*, and 120*d* engage the external surface of the tortilla and provide tortilla edge support to the top of the tortilla and thereby support the tortilla within the tortilla receiving chambers in a generally upright position.

The embodiment illustrated in FIG. 1 illustrates that the top wall 110 is curved to provide additional support for the tortilla supported therein. The top wall is curved in the present embodiment by way of bending the top wall 110 along a first top wall crease 152, a second top wall crease 154, a third top wall crease 156 and a fourth top wall crease 158. The intermediate wall 130 also includes intermediate wall support side walls 168 and 170 formed by folding intermediate wall 130 along a first intermediate wall crease 166 and a second intermediate wall crease 170. Intermediate wall 130 is positioned at a distance from bottom wall 150 that is the equivalent of the height of first and second intermediate wall support sidewalls 168 and 172. In addition, there is a crease 164 as illustrated in FIG. 2 along which the first intermediate wall support side wall 168 is folded and is hingedly connected to the base wall 150. The base wall 150 also includes a crease 160 between the base wall 150 and the third sidewall 108. The third sidewall 108 further includes a folding crease, which provides the hinged attachment between the third sidewall 108 and the top wall 110.

Figure 3:
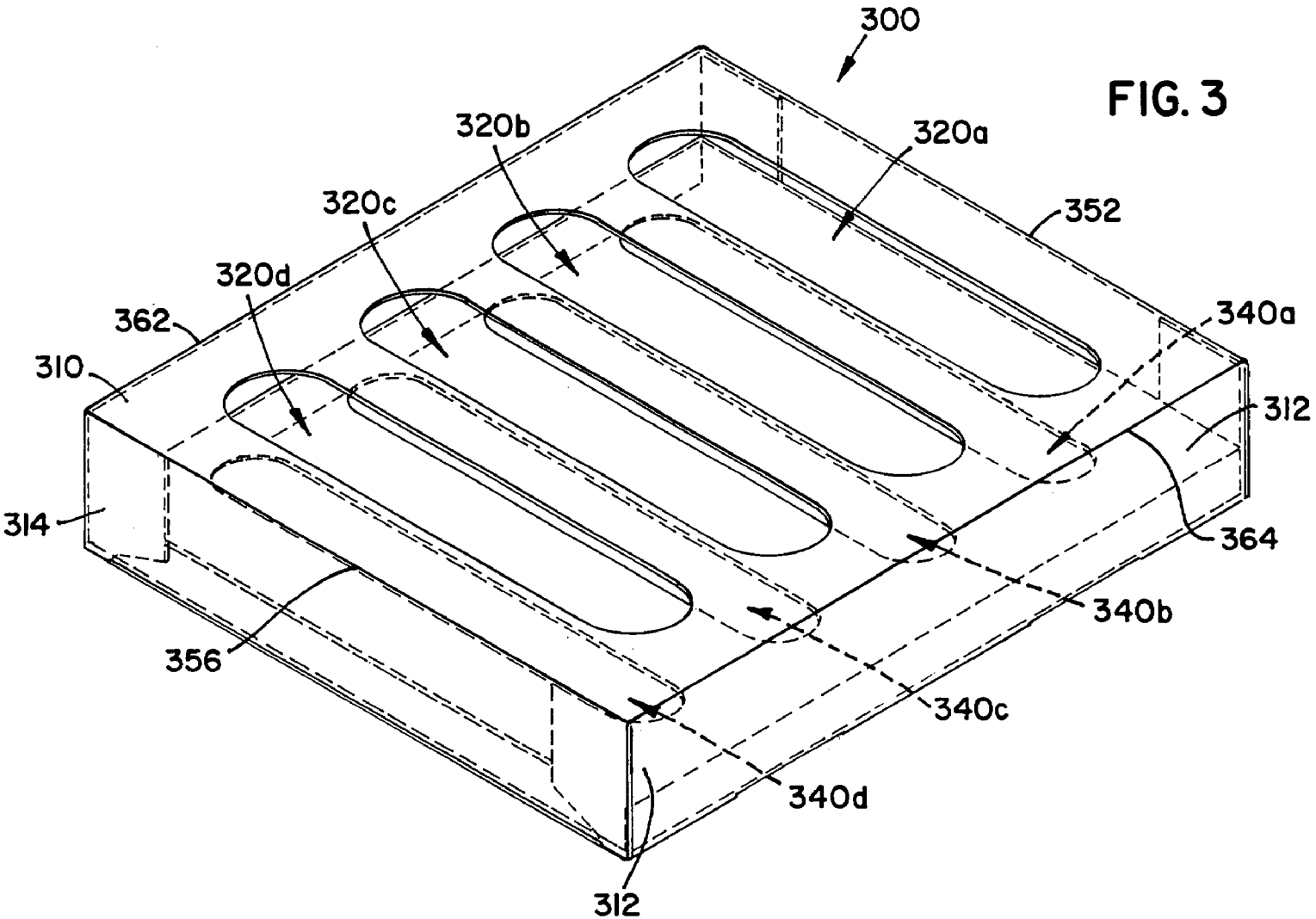
FIG. 3 is a prospective view of an alternative embodiment of a tortilla support apparatus of the present invention.
Figure 4:
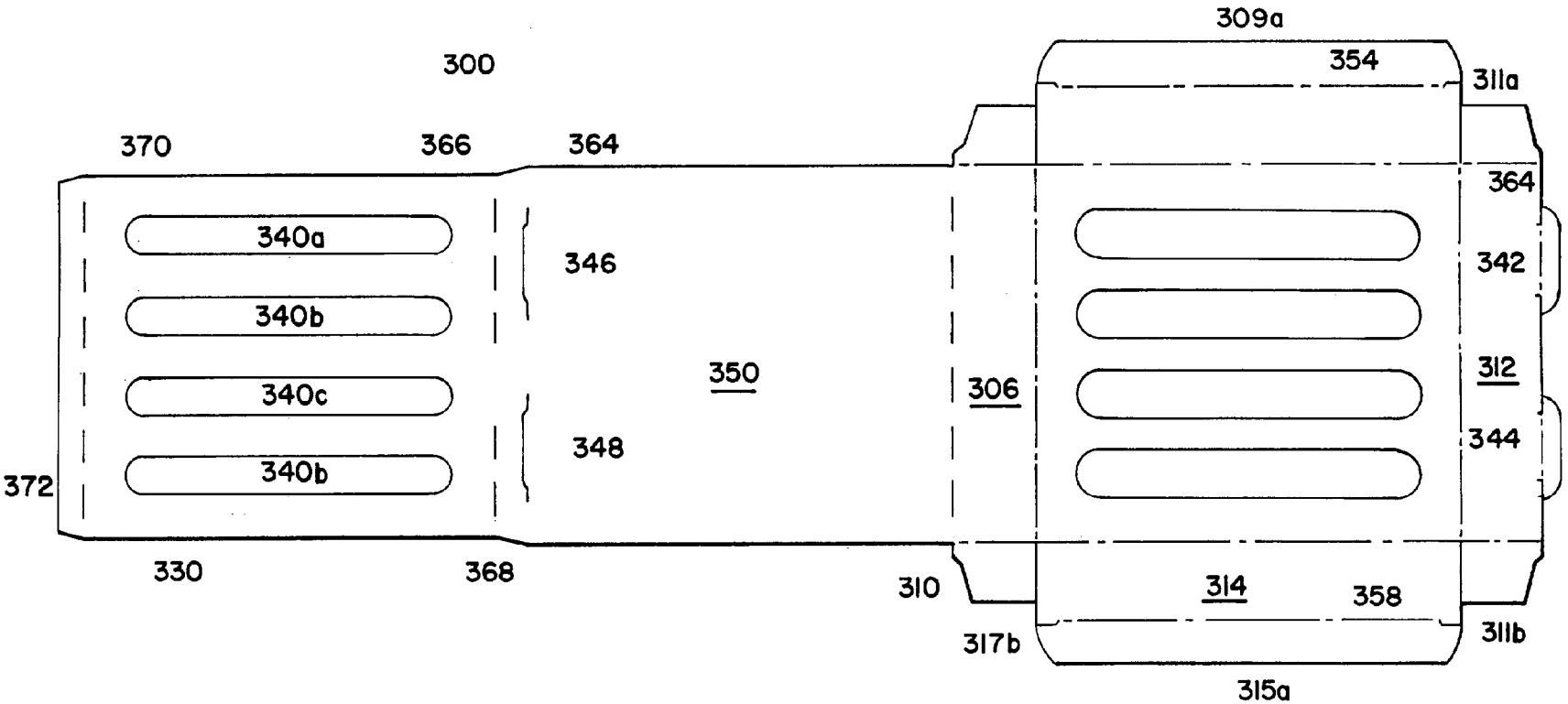
FIG. 4 is a prospective view of the tortilla support apparatus disclosed in FIG. 3 illustrating the apparatus in its flat storage position.

Another embodiment of the tortilla support apparatus is illustrated in FIGS. 3 and 4. As illustrated, the collapsible tortilla support apparatus 300 includes a first side wall 306, a second side wall 314, a third side wall 308, a fourth side wall 312, a base wall 350, and a top wall 310. The first, second, third and fourth side walls 306, 308, 312 and 314 are hingedly connected to top wall 310. The first sidewall 306 is hingedly connected to the top wall 310 via a hinged crease 362. The second sidewall 314 is hingedly connected to the top wall 310 via a hinged crease 356. The third sidewall 308 is hingedly connected to the top wall 310 via a hinged crease 364. The fourth sidewall 312 is hingedly connected to the top wall 310 via a hinged crease 356. In the preferred embodiment, the hinged crease connections between the top wall 310 and the sidewalls 306, 308, 312 and 314 is accomplished by a fold or a crease formed in the construction material of the tortilla support apparatus 300.

FIG. 3 illustrates the collapsible support apparatus 300 in its upright position. In its upright position, the sidewalls and top walls have been folded along hinged creases in order to stabilize the collapsible tortilla support apparatus 300 in its upright position. As illustrated in FIGS. 3 and 4, a first top wall crease 352 is formed between the top wall 310 and third sidewall 308. A second top wall crease 356 is formed between the top wall 310 and a second sidewall 314. A third top wall crease 362 is formed between top wall 310 and a first sidewall 306. A fourth top wall crease 364 is formed between top wall 310 and a fourth sidewall 312.

As illustrated in FIG. 3, top wall 310 is generally parallel with intermediate wall 330 and bottom wall 350 and the distance separating top wall 310 from bottom wall 350 is the equivalent of the height of sidewalls 306, 308, 312 and 314. The top wall creases which allow hinged movement of the side walls 306, 308, 312 and 314 in association with the top wall 310 also provides the hinged assembly necessary to allow the side walls and top wall 310 to be manipulated from the upright position illustrated in FIG. 3 to the flat storage position illustrated in FIG. 4.

Following the pivoting of the first, second and third side walls 306, 308, 312 and 314, to positions at which the first, second, third and fourth side walls 306, 308, 312 and 314 are generally perpendicular to the top wall 310 and base wall 350, the intermediate wall 130 is folded up and over the base wall 350 so that the intermediate wall 330 and the base wall 350 are generally parallel. The intermediate wall 330 is folded along a hinged crease 364 between the base wall 350 and the first intermediate wall support sidewall 368 and along a fourth hinge crease 366 between the intermediate wall 330 and the first intermediate wall support sidewall 368. Upon folding of intermediate wall 330, the first intermediate wall support sidewall 368 becomes generally perpendicular to the base wall 350 and the intermediate wall 330. Second intermediate wall support sidewall 372 is generally perpendicular to the intermediate wall 330. Intermediate wall is above base wall 350 in a generally parallel position at a distance the equivalent of the height of the first and second intermediate wall support sidewalls 368 and 372. In manipulating the collapsible tortilla support apparatus 300 to its upright position, illustrated in FIG. 3, the first and second top wall tabs 342 and 344 are slid through a first top wall tab receiving slot 346 and a second top wall receiving aperture 348.

As illustrated in FIGS. 3 and 4, collapsible tortilla support apparatus top wall 310 includes a plurality of tortilla receiving apertures 320*a*, 320*b*, 320*c* and 320*d*. Each of the tortilla receiving apertures has a length of approximately 5–7 inches and a width of approximately one inch, although the dimension may be modified as desired by the manufacturing of the present invention. The tortilla receiving apertures 320*a*, 320*b*, 320*c*, and 320*d* are designed to receive a tortilla. The intermediate wall 330 also includes a plurality of tortilla receiving apertures 340*a*, 340*b*, 340*c*, and 340*d*, each of which has a length of approximately one half inch short of any length of the tortilla receiving apertures of top wall 310, and a width of approximately one fourth of an inch shorter than the width of the tortilla receiving apertures of the top wall 310. It is to be understood that these dimensions may be modified as desired by the manufacture of the present invention. The tortilla receiving apertures 340*a*, 340*b*, 340*c* and 340*d* are designed to receive a tortilla and the aperture edges engage the external surface of the tortilla and provide medium range stabilization support to the center of the tortilla as the edges of the top wall tortilla receiving apertures 320*a*, 320*b*, 320*c* and 320*d* engage the external surface of the tortilla and provide edge support toward the top of the tortilla. It is the medium range support of the tortilla receiving apertures 340*a*, 340*b*, 340*c* and 340*d* which provide the stabilization needed in collapsible tortilla support apparatuses.

As illustrated in FIG. 4, the sidewalls 306, 308, 312 and 314 include sidewall support tabs. First sidewall 306 has first side wall support tabs 307*a* and 307*b*. Second sidewall 314 has second sidewall support tab 315*a*. Third sidewall 308 has third sidewall support tab 309*a*. Fourth sidewall 312 has fourth side wall support tabs 311*a* and 311*b*. Sidewall support tabs 307*a* and 307*b*, 309*a*, 311*a*, 311*b*, and 315*a* are engaged as illustrated in FIG. 3 to stabilize the tortilla support apparatus 300 in its upright position. The intermediate wall 330 also includes intermediate support walls 368 and 372. Intermediate support wall 368 is formed by folding intermediate wall 330 along a first intermediate wall crease 366 which is between the base wall 330 and first intermediate wall support 368. The second intermediate wall support sidewall 372 is formed by folding intermediate wall 330 along an intermediate wall crease 370. Upon folding intermediate wall 330 along the first and second intermediate wall creases 366 and 370, intermediate wall 330 is positioned at a distance from bottom wall 350 that is equivalent to the height of the first and second intermediate wall support side walls 368 and 372. In addition, there is a crease 364 as illustrated in FIG. 4 along which the first intermediate wall support side wall 368 is folded and is hingedly connected to the base wall 350. The base wall 350 also includes a crease 360 between the base wall 350 and the first sidewall 306.

Figure 5:
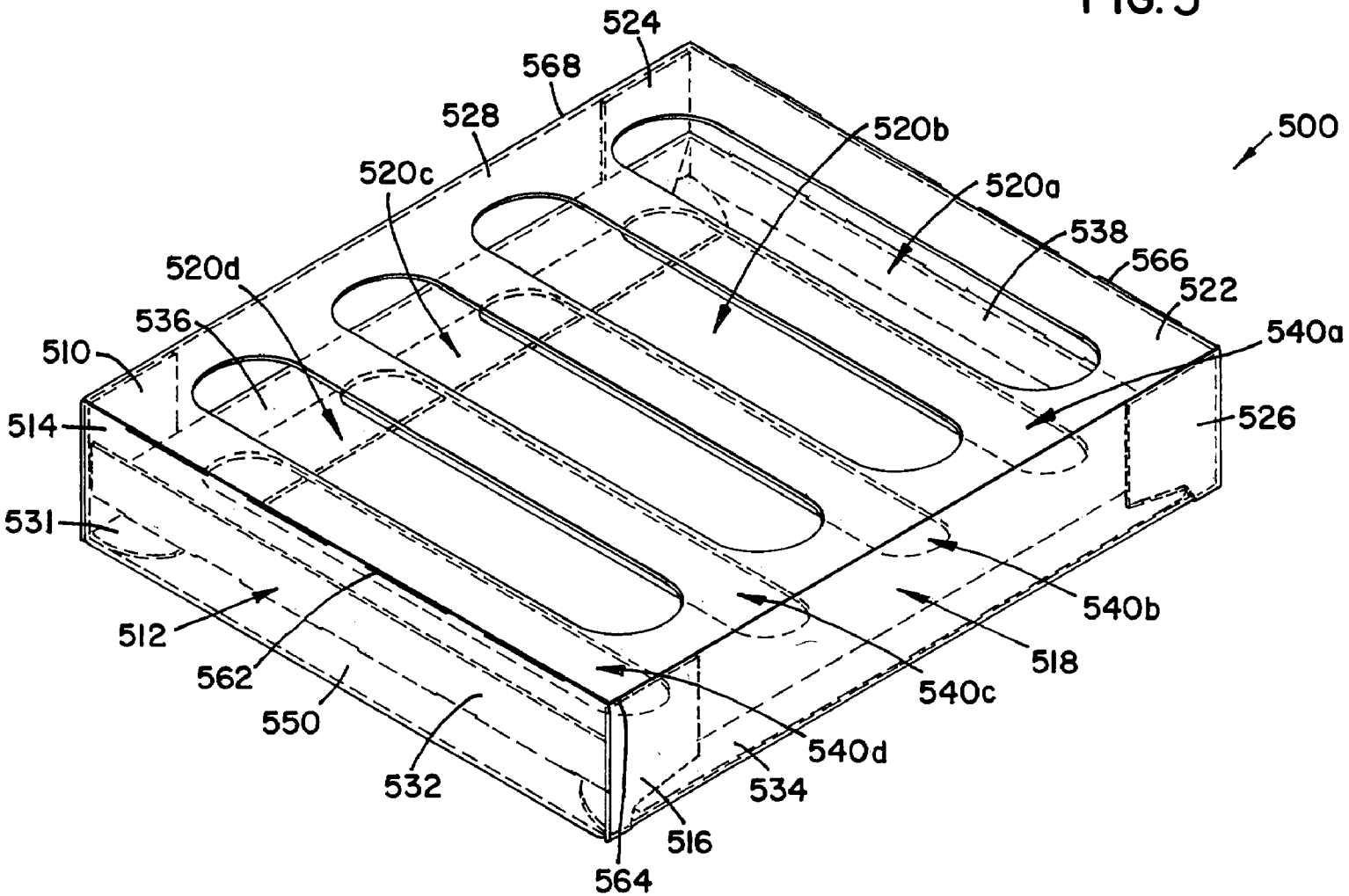
FIG. 5 is a prospective view of an alternative embodiment of a popup collapsible tortilla support apparatus of the present invention.
Figure 6:
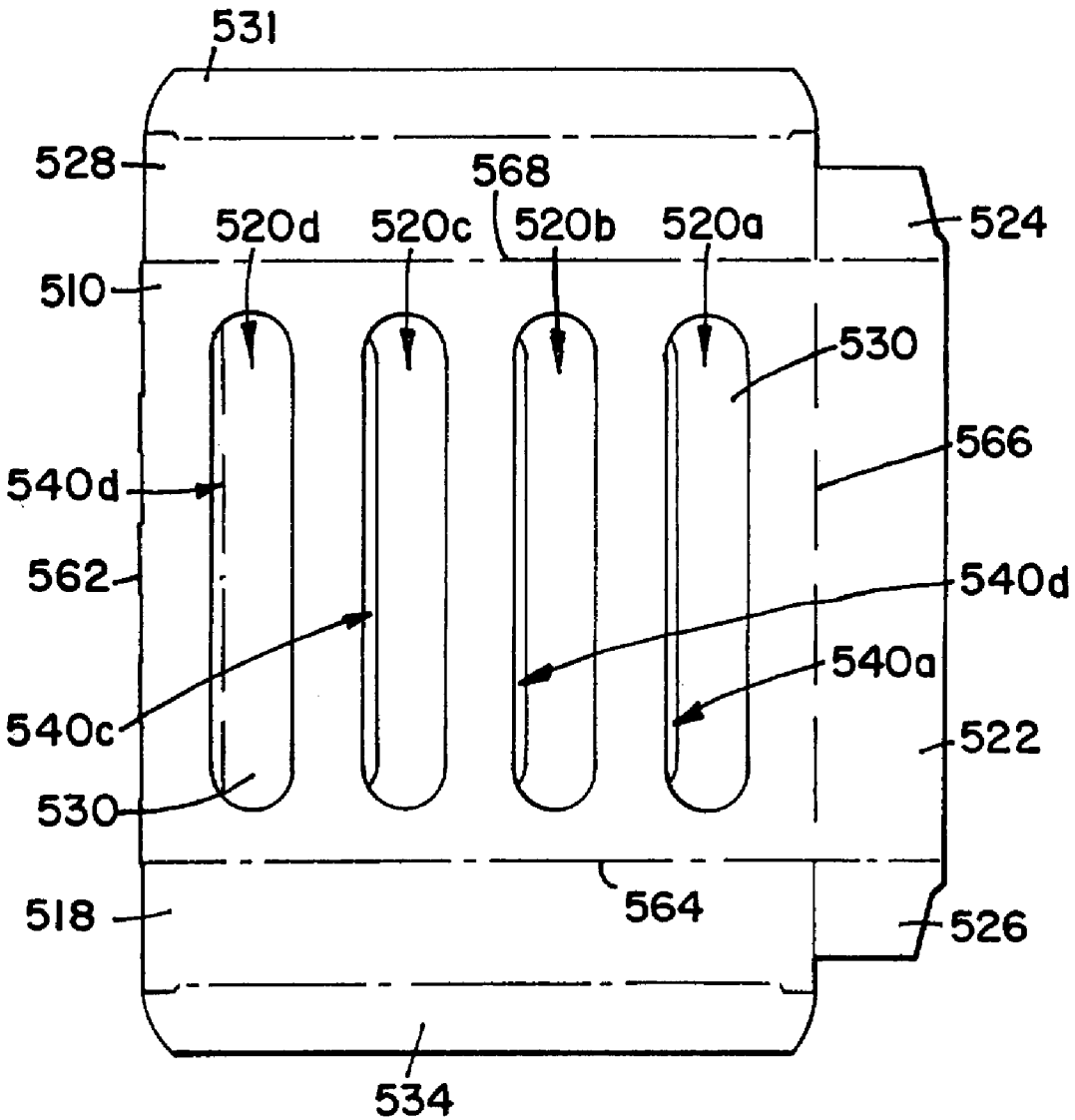
FIG. 6 is a prospective view of the tortilla support apparatus disclosed in FIG. 5 illustrating movement of its sidewalls and support flaps into position which allow it to be collapsed into a flat storage position.

Another embodiment of the present invention is illustrated in FIGS. 5 and 6. The embodiment illustrated is generally a popup box shaped tortilla support apparatus 500 having tortilla receiving apertures 520*a–d* formed in the top wall of the collapsible tortilla support apparatus 500, including an intermediate wall support system positioned within the collapsible tortilla support apparatus 500. As illustrated in FIG. 5, the embodiment of the collapsible tortilla support apparatus 500 includes a top wall 510, a side wall assembly comprised of four side walls, a first side wall 512, a second side wall 518, a third side wall 522 and a fourth side wall 528. The first, second, third and fourth side walls 512, 518, 522 and 528 are hingedly connected to the top wall 510. In the preferred embodiment, the hinged connection between the top wall and the first, second, third and fourth side walls 512, 518, 522 and 528 is accomplished by a fold or crease formed in the construction material of the tortilla support apparatus. As illustrated in FIGS. 5 and 6, a first hinged crease 562 is positioned between the top wall 510 and first sidewall 512. A second hinged crease 564 is positioned between the top wall 510 and the second sidewall 518. A third hinged crease 566 is positioned between the third sidewall 522 and the top wall 510. A fourth hinged crease 568 is positioned between the fourth sidewall 528 and top wall 510. Hinged creases 562, 564 and 568 provide the hinged assembly necessary to permit the top wall and the sidewalls to be pivoted from the upright position illustrated in FIG. 5 to the flat storage position illustrated in FIG. 6. Upon pivoting to the upright position of the collapsible tortilla support apparatus 500, the sidewalls 512, 518, 522 and 528 are perpendicular to the top wall 510, the intermediate wall 530 and the base wall 550. The intermediate wall 530 also includes intermediate wall support sidewalls that support the intermediate wall and positions the intermediate wall substantially parallel to the base wall 550 when the collapsible tortilla support apparatus is in its upright position. The intermediate wall 530 includes intermediate wall tortilla receiving apertures 540*a*, 540*b*, 540*c*, 540*d*.

When the collapsible tortilla support apparatus 500 is collapsed, the second and fourth side walls 564 are pivoted along hinged creases 564 and 568 and provide the ability for the tortilla support apparatus 500 to be pivoted along hinged creases 562 and 566 into a flat storage position as illustrated in FIG. 6. Second and fourth sidewalls 518 and 528 have second sidewall support flap 534 and a third side wall support flap 531 attached hereto. The support flaps 534 and 531 engage the base wall of the collapsible tortilla support apparatus 500 to stabilize the apparatus in an upright storage position.

As illustrated in FIGS. 5 and 6, collapsible tortilla support apparatus top wall 510 includes a plurality of tortilla receiving apertures 520*a*, 520*b*, 520*c* and 520*d*, each having a length of approximately 5–7 inches and a width of approximately one inch, although the dimensions may be modified as desired by the manufacturing of the present invention. The tortilla receiving apertures 520*a*, 520*b*, 520*c* and 520*d*, are designed to receive a tortilla. The intermediate wall 530 also includes a plurality of tortilla receiving apertures 540*a*, 540*b*, 540*c* and 540*d*, each of which has a length of approximately one half inch shorter than the length of the tortilla receiving apertures of top wall 510, and a width of approximately one fourth of an inch shorter than the width of the tortilla receiving apertures of the top wall 510. It is to be understood that these dimensions may be modified as desired by the manufacturer of the present invention. The tortilla receiving apertures 540*a*, 540*b*, 540*c* and 540*d* are designed to receive a tortilla and the aperture edges engage the external surface of the tortilla and provide medium range stabilization support to the center of the tortilla as the edges of the apertures of the top wall 520*a*, 520*b*, 520*c* and 520*d* engage the external surface of the tortilla and provide the tortilla edge support to the top of the tortilla and thereby support the tortilla within the tortilla receiving chambers in a generally upright position.

Figure 7:
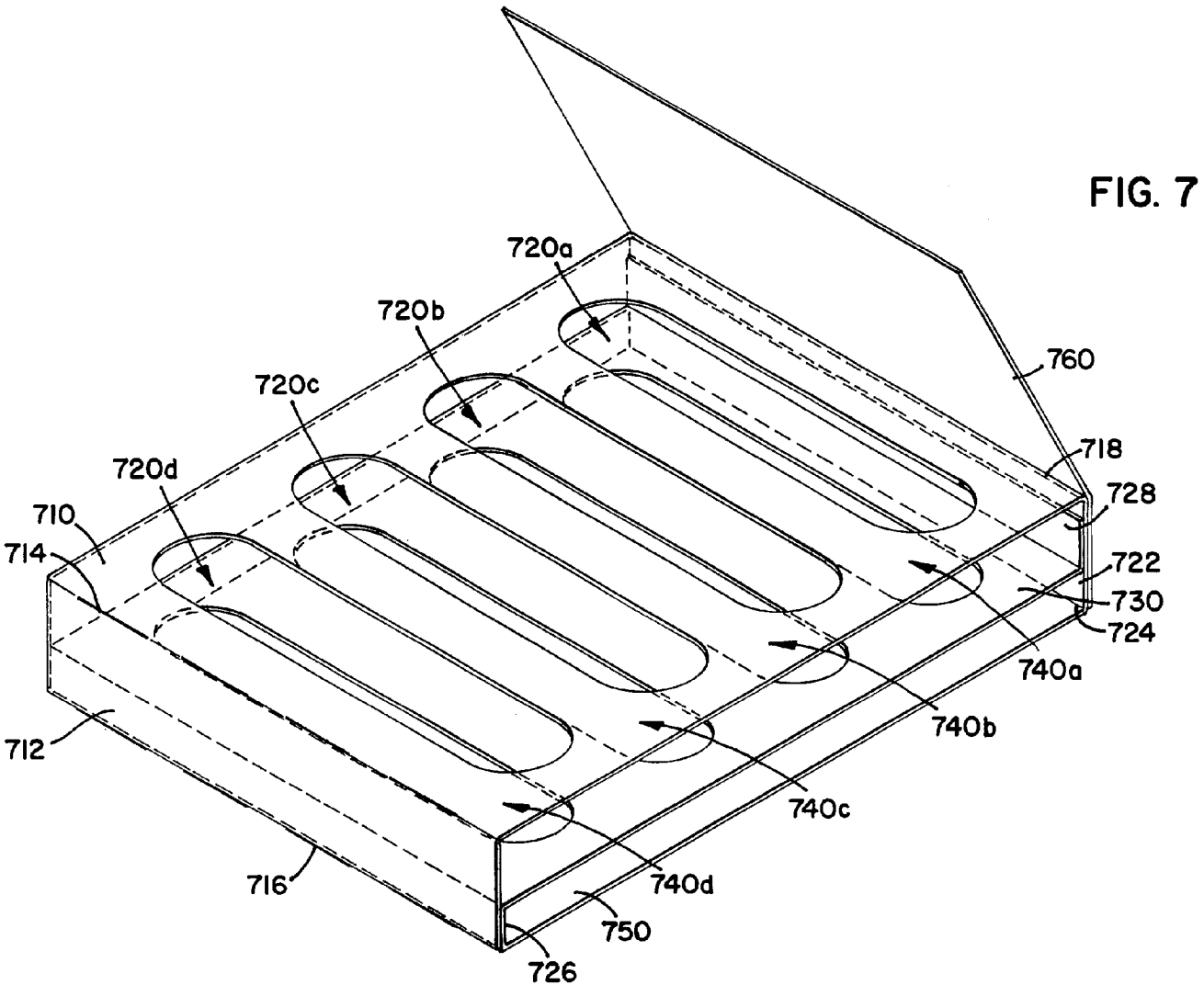
FIG. 7 is a prospective view of a popup tortilla support apparatus of the present invention with the advertising placard mounted thereon.
Figure 8:
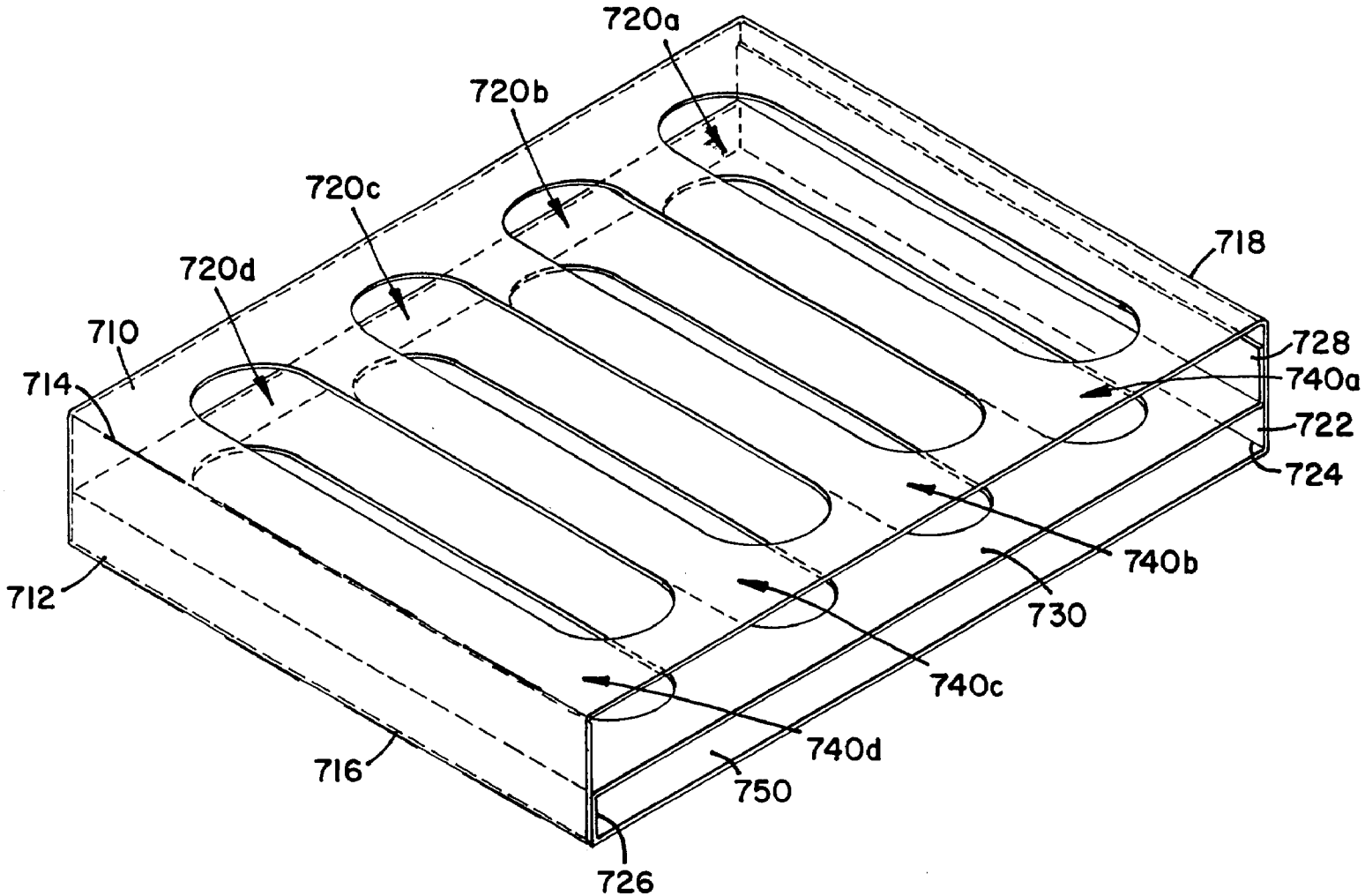
FIG. 8 is a prospective view of the popup tortilla support apparatus illustrated in FIG. 7 shown without the advertising placard.
Figure 9:
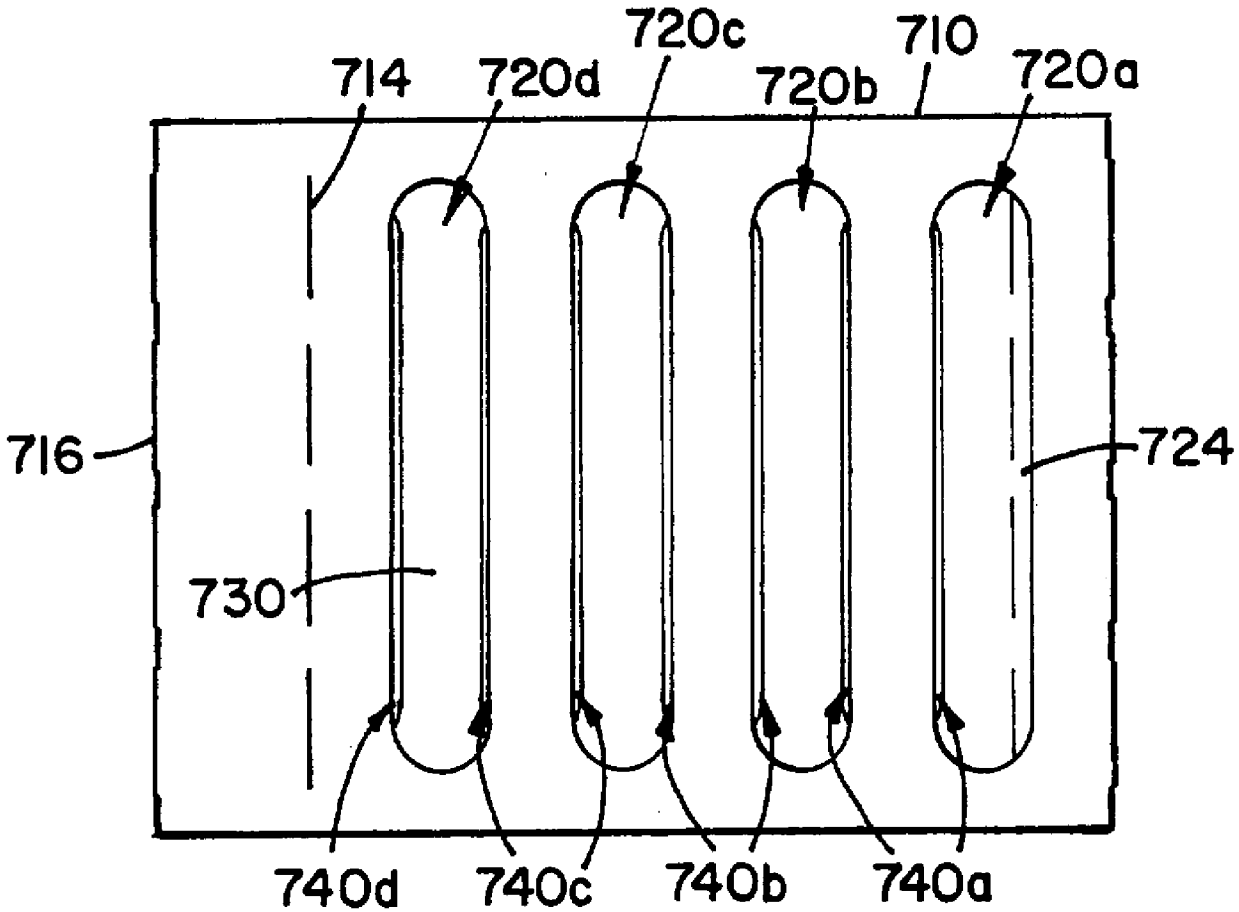
FIG. 9 is a prospective view of the popup tortilla support apparatus illustrated in FIG. 8 shown in its collapsed storage position.

As illustrated in FIGS. 7, 8 and 9, another embodiment of the collapsible tortilla support apparatus 700 is shown to include first and second sidewalls 712 and 722, a base wall 750, and a top wall 710. The first and second sidewalls 712 and 722 are hingedly connected to the top wall 710 and base wall 750. In the preferred embodiment, the hinged connection between the base wall 750 and the first sidewall 712, and the second side wall 722 is accomplished by a fold or crease formed in the construction material of the tortilla support apparatus 700. A first hinged top wall crease 714 is positioned between the top wall 710 and the first sidewall 712. A second hinged crease 716 is positioned between the first sidewall 712 and the base wall 750. A third hinged top wall crease 718 is positioned between the top wall 710 and the second sidewall 722. A fourth hinged crease 716 is positioned between the second sidewall 722 and the base wall 750. Hinged creases 714, 716, 718 and 724 provides the hinge assembly necessary to permit the top wall 710 and the first and second sidewalls 712 and 722 to be pivoted from the upright position illustrated in FIGS. 7 and 8 to the flat storage position illustrated in FIG. 9.

As illustrated, the collapsible tortilla support apparatus top wall 710 includes a plurality of tortilla receiving apertures 720*a*, 720*b*, 720*c*, and 720*d*, each which have a length of approximately 5–7 inches and a width of approximately one inch, although the dimensions may be modified as desired by the manufacturing of the present invention. The tortilla receiving apertures 720*a*, 720*b*, 720*c*, and 720*d*, are designed to receive a tortilla. The intermediate wall 730 also includes a plurality of tortilla receiving apertures 740*a*, 740*b*, 740*c* and 740*d*, each of which has a length of approximately one half inch shorter than the length of the tortilla receiving apertures of top wall 710, and a width of approximately one fourth of an inch shorter than the width of the tortilla receiving apertures of the top wall 710. It is to be understood that these dimensions may be modified as desired by the manufacture of the present invention. The tortilla receiving apertures 740*a*, 740*b*, 740*c* and 740*d* are designed to receive a tortilla and the aperture edges engage the external surface of the tortilla and provide medium range stabilization support to the center of the tortilla as the edges of the top wall tortilla receiving apertures 720*a*, 720*b*, 720*c*, and 720*d* engage the external surface of the tortilla and provide tortilla edge support to the top of the tortilla and thereby support the tortilla within the tortilla receiving chambers in a generally upright position.

As illustrated in FIGS. 7 and 8, the tortilla receiving apertures 740*a*, 740*b*, 740*c* and 740*d* of the intermediate wall 730 are directly underneath tortilla receiving apertures 720*a*, 720*b*, 720*c*, and 720*d* of the top wall, thereby creating two levels of edge support and tortilla receiving chambers. Upon the pivoting of first and second sidewalls 712 and 722 up to a flat storage position at which first and second sidewalls 712 and 722 are parallel to the base wall 750 and top wall 710, the intermediate wall 730 and the respective tortilla receiving apertures 740*a*, 740*b*, 740*c* and 740*d* are shifted over so that the apertures are no longer directly underneath the top wall tortilla receiving apertures 720*a*, 720*b*, 720*c*, and 720*d* as illustrated in FIG. 9. This embodiment is a collapsible pop-up because it is manipulated into its upright position with no support other than the hinged creases 714, 716, 718 and 724.

When the collapsible tortilla support apparatus 700 pops up from its resting position, a first intermediate wall support sidewall 726 becomes generally perpendicular to the top wall 710, the base wall 150 and the intermediate wall 730. Second intermediate wall support sidewall 728 is folded along a hinged crease so that the second intermediate wall support sidewall 728 is generally perpendicular to the intermediate wall 130 and parallel to the first side wall 712. Intermediate wall 730 is above base wall 750 in a generally parallel position at a distance the equivalent of the height of first intermediate wall support sidewall 726. FIG. 7 illustrates the embodiment illustrated in FIGS. 7–9 as including an advertising placard 760. The advertising placard 760 is mounted to on the second sidewall 722. When collapsible tortilla support apparatus 700 I sin its generally flat storage position, the placard 760 also lays flat against the top wall 710, or it could be folded in the opposite direction so long as the apparatus 700 lays flat. Upon the collapsible tortilla support apparatus 700 being expanded to its tortilla holder position as illustrated in FIG. 7, the placard 760 extends upwards behind the tortillas being supported in the tortilla receiving apertures 720*a*, 720*b*, 720*c*, and 720*d* and can be printed upon to display various types of advertising. The placard 760 thus can provide a simple and vivid means of advertising for a business using or distributing the present invention.

While the invention has been particularly shown and described with reference to preferred embodiments thereof, it will be understood by those skilled in the art that various other changes in the form and details may be made therein without departing from the spirit and scope of the invention. The foregoing description of the exemplary embodiments of the invention has been presented for purposes of illustration and description. It is not intended to be exhaustive or to limit the invention to the precise form disclosed. Many modifications and variations are possible in light of the above teaching. It is intended that the scope of the invention be limited not with this detailed description, but rather by the claims appended hereto.

We claim:

1. A collapsible tortilla support apparatus, configured to stabilize tortillas in an upright position, the apparatus comprising:

a base wall;

a top wall;

an intermediate wall disposed between the base wall and the top wall;

a sidewall assembly, integrally coupled to the base wall and the top wall, respectively;

wherein the top wall includes a plurality of apertures configured to receive tortillas formed therein;

wherein the intermediate wall includes a plurality of apertures configured to receive tortillas formed therein;

wherein the edges of each of the plurality of apertures configured to receive tortillas formed in the top wall and the edges of each of the plurality of apertures configured to receive tortillas formed in the intermediate wall serve to stabilize tortillas in an upright position.

2. A collapsible tortilla support apparatus, wherein the apparatus is generally an upright rectangular box that is collapsible to a generally flat storage position, the apparatus comprising:

a base wall;

a top wall including a plurality of apertures, wherein each aperture is configured to receive tortillas;

an intermediate wall disposed between the base wall and the top wall and including a plurality of apertures, wherein each aperture is configured to receive tortillas; and oppositely disposed first and second sidewalls, hingedly coupled to the base plate and the top wall, respectively;

wherein the edges of the apertures configured to receive tortillas in the top wall and the intermediate wall serve to stabilize a tortilla positioned through a top wall aperture and an intermediate wall aperture and resting on the base wall.

3. The tortilla support apparatus of claim 2, further comprising a third sidewall having a first end coupled to one of the base wall and the top wall such that upon engagement of a second end of the third sidewall to one of the base wall and the top wall the collapsible tortilla support apparatus is stabilized to an upright tortilla support position.

4. The tortilla support apparatus of claim 2, wherein the first end of a third sidewall is hingedly connected to the top wall and the second end of the third sidewall engages the base wall and thereby stabilizes the collapsible tortilla support apparatus in an upright tortilla support position.

5. The tortilla support apparatus of claim 3, wherein the second end of the of the third sidewall has an engagement flap operative to removably attach the third sidewall to the base wall and thereby secure the collapsible tortilla support apparatus in an upright position.

6. The tortilla support apparatus of claim 2, wherein the first end of a third sidewall is hingedly connected to the base wall and the second end of the third sidewall engages the top wall and thereby stabilizes the collapsible tortilla support apparatus in an upright tortilla support position.

7. The tortilla support apparatus of claim 3, wherein the second end of the of the third sidewall has an engagement flap operative to removably attach the third sidewall to the top wall and thereby secure the collapsible tortilla support apparatus in an upright position.

8. The tortilla support apparatus of claim 3, wherein one of the oppositely disposed first and second sidewalls has an engagement flap attached thereto and operative to removably attach one of the oppositely disposed first and second sidewalls to the top wall and thereby secure the collapsible tortilla support apparatus in an upright position.

9. The tortilla support apparatus of claim 3, wherein one of the oppositely disposed first and second sidewalls has an engagement flap attached thereto and operative to removably attach one of the oppositely disposed first and second sidewalls to the base wall and thereby secure the collapsible tortilla support apparatus in an upright position.

* * * * *